US011396856B2

(12) United States Patent
Higashi et al.

(10) Patent No.: US 11,396,856 B2
(45) Date of Patent: Jul. 26, 2022

(54) FUEL SUPPLY DEVICE

(71) Applicant: AISAN KOGYO KABUSHIKI KAISHA, Obu (JP)

(72) Inventors: Shinya Higashi, Tokai (JP); Koji Yoshida, Kasugai (JP); Satoshi Nakamura, Ichinomiya (JP); Masashi Go, Nagoya (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 17/285,580

(22) PCT Filed: Oct. 1, 2019

(86) PCT No.: PCT/JP2019/038762
§ 371 (c)(1),
(2) Date: Apr. 15, 2021

(87) PCT Pub. No.: WO2020/080098
PCT Pub. Date: Apr. 23, 2020

(65) Prior Publication Data

US 2021/0396196 A1 Dec. 23, 2021

(30) Foreign Application Priority Data

Oct. 15, 2018 (JP) ..... JP2018-194220

(51) Int. Cl.
*F02M 37/00* (2006.01)
*F02M 37/44* (2019.01)
(Continued)

(52) U.S. Cl.
CPC ..... *F02M 37/0052* (2013.01); *F02M 37/106* (2013.01); *F02M 37/44* (2019.01); *F02M 37/08* (2013.01); *F02M 2037/082* (2013.01)

(58) Field of Classification Search
CPC combination set(s) only.
See application file for complete search history.

(56) References Cited

U.S. PATENT DOCUMENTS 4,869,225 A * 9/1989 Nagata ..... F02M 37/106 123/514
5,263,458 A 11/1993 Fujino et al.
(Continued)

FOREIGN PATENT DOCUMENTS

CN 108779746 A * 11/2018 ..... B60K 15/01
CN 108779746 B * 4/2020 ..... B60K 15/01
(Continued)

OTHER PUBLICATIONS

PCT/JP2019/038762 International Preliminary Report on Patentability dated Apr. 15, 2021 (6 p.).
(Continued)

*Primary Examiner* — Kevin R Steckbauer
(74) *Attorney, Agent, or Firm* — Conley Rose, P.C.

(57) ABSTRACT

A fuel supply device includes a fuel pump, a sub-tank configured to store a fuel, a leakage passage configured to return a part of a pressurized fuel discharged from the fuel pump into the sub-tank, and a fuel filter disposed at a bottom part of the sub-tank. The fuel filter includes a filter member that is configured to filter the fuel to be suctioned into the fuel pump. A downstream end of the leakage passage includes a linear passage part linearly extending from a position above the filter member toward the filter member. The fuel supply device also includes a direction change wall part configured to change the flow direction of the pressurized fuel jetted from the linear passage part so as to prevent the pressurized fuel from directly impacting the filter member.

15 Claims, 9 Drawing Sheets

(51) Int. Cl.
*F02M 37/10* (2006.01)
*F02M 37/08* (2006.01)

(56) References Cited

U.S. PATENT DOCUMENTS 5,482,444 A * 1/1996 Coha ..... F02M 37/106 417/363
6,098,600 A * 8/2000 Umetsu ..... F02M 37/106 123/514
6,241,883 B1 * 6/2001 Noda ..... B01D 35/26 210/172.3
6,694,785 B1 * 2/2004 Hsieh ..... B60R 25/0225 70/237
6,752,129 B2 * 6/2004 Isozaki ..... F02M 37/103 417/363
6,923,164 B1 * 8/2005 Mitsudou ..... F02M 37/103 123/514
7,108,487 B2 * 9/2006 Koba ..... F02M 37/103 417/360
7,124,748 B2 * 10/2006 Gaffield ..... F02M 37/0094 123/509
7,182,869 B2 * 2/2007 Catlin ..... B01D 35/0273 55/482
7,210,465 B2 * 5/2007 Ikeya ..... F02M 37/106 123/514
7,237,538 B2 * 7/2007 Perruchot ..... F02M 37/106 123/509
7,389,768 B2 * 6/2008 Hayakawa ..... F02M 37/106 137/565.34
7,415,974 B2 * 8/2008 Akiba ..... F02M 37/106 123/511
7,472,693 B2 * 1/2009 Izutani ..... F02M 37/46 123/509
8,365,942 B2 * 2/2013 Nakajima ..... B60K 15/077 137/574
8,689,827 B2 * 4/2014 Okazono ..... B01D 35/027 137/565.37
9,328,704 B2 * 5/2016 Okazono ..... F02M 37/103
9,539,893 B2 * 1/2017 Hsu ..... B60K 15/04
9,803,594 B2 * 10/2017 Ishitoya ..... F02M 37/106
10,012,189 B2 * 7/2018 Kondo ..... F02M 37/10
10,054,089 B2 * 8/2018 Takahashi ..... F02M 55/04
10,215,614 B2 * 2/2019 Flynn ..... B60K 15/03
10,247,597 B2 * 4/2019 Flynn ..... B60K 15/03
10,436,161 B2 * 10/2019 Kim ..... F02M 37/50
10,443,552 B2 * 10/2019 Fukuoka ..... F02M 37/00
10,544,762 B2 * 1/2020 Fukui ..... F02M 37/106
10,634,102 B2 * 4/2020 Soreo ..... F02M 37/103
10,641,218 B2 * 5/2020 Fujiseki ..... F02M 37/103
10,648,436 B2 * 5/2020 Adachi ..... F02M 37/0082
10,669,976 B2 * 6/2020 Fukuoka ..... F02M 37/0082
10,690,096 B2 * 6/2020 Hayashi ..... F02B 37/025
10,704,514 B2 * 7/2020 Kobayashi ..... F02M 37/00
10,766,357 B2 * 9/2020 Adachi ..... F02M 37/22
10,780,794 B2 * 9/2020 Zenner ..... H01M 10/66
10,794,342 B2 * 10/2020 Maruyama ..... F02M 37/10
10,850,606 B2 * 12/2020 Niwa ..... F02M 37/0076
10,865,750 B2 * 12/2020 Soreo ..... B01D 35/0273
10,907,593 B2 * 2/2021 Higashi ..... F02M 37/50
11,118,549 B2 * 9/2021 Ito ..... F02M 37/103
11,174,824 B2 * 11/2021 Ito ..... B60K 15/04
2001/0001963 A1 * 5/2001 Murakoshi ..... F02M 37/103 137/565.34
2002/0046739 A1 * 4/2002 Okada ..... F02M 25/089 123/518
2003/0106537 A1 * 6/2003 Isozaki ..... F02M 37/103 417/363
2004/0037714 A1 * 2/2004 Koba ..... F02M 37/103 417/360
2004/0074995 A1 * 4/2004 Okada ..... B01D 35/26 239/533.1
2004/0163630 A1 * 8/2004 Powell ..... F02M 37/025 123/509
2005/0155583 A1 * 7/2005 Mitsudou ..... F02M 37/44 123/509
2005/0166974 A1 * 8/2005 Hashiguchi ..... F02M 37/025 137/571
2005/0217733 A1 * 10/2005 Hayakawa ..... F02M 37/106 137/565.17
2005/0274361 A1 * 12/2005 Ikeya ..... F02M 37/106 123/457
2006/0130815 A1 * 6/2006 Gaffield ..... F02M 37/103 123/509
2007/0056567 A1 * 3/2007 Perruchot ..... F02M 37/106 123/509
2007/0215115 A1 * 9/2007 Hazama ..... F02D 41/3082 123/497
2009/0028690 A1 * 1/2009 Kawajiri ..... F02M 37/048 415/55.1
2010/0133283 A1 * 6/2010 Nakajima ..... B60K 15/077 220/694
2011/0139278 A1 * 6/2011 Kawajiri ..... F02M 37/025 137/565.01
2011/0168134 A1 * 7/2011 Lim ..... F02M 37/106 123/509
2011/0174275 A1 * 7/2011 Lim ..... F02M 37/106 123/514
2012/0060948 A1 * 3/2012 Okazono ..... B60K 15/077 137/565.17
2015/0330341 A1 * 11/2015 Rossi ..... B60K 15/03 29/428
2016/0238172 A1 * 8/2016 Ishitoya ..... F02M 37/50
2017/0241386 A1 * 8/2017 Mason ..... F02M 37/0029
2017/0248106 A1 * 8/2017 Niwa ..... F02M 37/10
2017/0268470 A1 * 9/2017 Murakoshi ..... F02M 37/00
2017/0268471 A1 * 9/2017 Fukui ..... F02M 37/10
2017/0276105 A1 * 9/2017 Kondo ..... F02M 37/00
2017/0314522 A1 * 11/2017 Takahashi ..... F02M 37/103
2017/0328318 A1 * 11/2017 Fukui ..... F02M 37/103
2018/0031408 A1 * 2/2018 Flynn ..... G01F 23/683
2018/0328323 A1 * 11/2018 Fukuoka ..... G01F 23/38
2019/0009670 A1 * 1/2019 Adachi ..... B60K 15/03
2019/0017474 A1 * 1/2019 Adachi ..... F02M 37/106
2019/0024615 A1 * 1/2019 Hayashi ..... F02M 37/0052
2019/0024617 A1 * 1/2019 Fukui ..... F02M 37/103
2019/0032614 A1 * 1/2019 Fukuoka ..... F02M 37/0082
2019/0047405 A1 * 2/2019 Niwa ..... F02M 37/103
2019/0078541 A1 * 3/2019 Kobayashi ..... F02M 37/00
2019/0136809 A1 * 5/2019 Iseki ..... F02M 37/106
2019/0136810 A1 * 5/2019 Niwa ..... F02M 37/103
2019/0211785 A1 * 7/2019 Akiba ..... F02M 37/10
2019/0331073 A1 * 10/2019 Higashi ..... F02M 37/0017
2020/0080524 A1 * 3/2020 Soreo ..... F02M 37/106
2020/0080525 A1 * 3/2020 Soreo ..... F04B 49/04
2020/0173407 A1 * 6/2020 Soreo ..... F02M 37/103
2021/0025360 A1 * 1/2021 Ito ..... F02M 37/103
2021/0025361 A1 * 1/2021 Ito ..... B60K 15/03
2021/0033051 A1 * 2/2021 Ito ..... F02M 37/103
2021/0033053 A1 * 2/2021 Hayashi ..... F02M 37/103
2021/0396196 A1 * 12/2021 Higashi ..... F02M 37/44

FOREIGN PATENT DOCUMENTS

DE 102016206478 A1 * 10/2017 ..... F02M 37/10
DE 112019004616 T5 * 6/2021 ..... F02M 37/0052
EP 1008745 A1 6/2000
JP H05124445 A 5/1993
JP 11324843 A * 11/1999 ..... B60K 15/077
JP 2006029317 A 2/2006
JP 2006105148 A 4/2006
JP 2009257308 A 11/2009
JP 2014141894 A * 8/2014 ..... F02M 37/10
JP 2017040242 A 2/2017
JP 2017172342 A * 9/2017 ..... B60K 15/01
JP 6424854 B2 * 11/2018 ..... B60K 15/01
JP 2020063671 A * 4/2020 ..... F02M 37/0052
WO 0000734 A1 1/2000
WO WO-2015189981 A1 * 12/2015 ..... F02M 37/10
WO WO-2017126316 A1 * 7/2017 ..... F02M 37/10
WO 2017141628 A1 8/2017
WO 2017159278 A1 9/2017

(56) References Cited

FOREIGN PATENT DOCUMENTS

| | | | | |
|---|---|---|---|---|
| WO | WO-2017159278 | A1 * | 9/2017 | ..... B60K 15/01 |
| WO | WO-2017182180 | A1 * | 10/2017 | ..... F02M 37/10 |
| WO | WO-2020080098 | A1 * | 4/2020 | ..... F02M 37/0052 |

OTHER PUBLICATIONS

PCT/JP2019/038762 International Search Report and Written Opinion dated Dec. 17, 2019 (11 p.).
PCT/JP2019/038762 Article 34 Amendments (5 p.).
PCT/JP2019/038762 PCT Written Response dated Jun. 25, 2020 (6 p.).
Japanese Office Action dated Feb. 18, 2022, for Japanese Application No. 2018-194220 (6 p.).
English Translation of Japanese Office Action dated Feb. 18, 2022, for Japanese Application No. 2018-194220 (6 p.).

* cited by examiner

FUEL SUPPLY DEVICE

CROSS-REFERENCE TO RELATED APPLICATIONS

The present application is a 35 U.S.C. § 371 U.S. National Phase entry of, and claims the benefit of, PCT Application No. PCT/JP2019/038762 filed Oct. 1, 2019, which claims priority to Japanese Patent Application No. 2018-194220 filed Oct. 15, 2018, each of which is incorporated herein by reference in their entirety for all purposes.

STATEMENT REGARDING FEDERALLY SPONSORED RESEARCH OR DEVELOPMENT

Not applicable.

BACKGROUND

The present disclosure generally relates to fuel supply devices.

One type of fuel supply device includes a fuel pump, a sub-tank, a leakage passage, and a fuel filter as, for example, shown in International Patent Publication No. WO2017/141628. The fuel filter is disposed at a bottom of the sub-tank and includes a bag-like filter member for filtering fuel to be suctioned into the fuel pump. When the fuel pump is driven, the fuel pump suctions the fuel in a fuel tank and the fuel in the sub-tank via the fuel filter. The fuel pump pressurizes and discharges the fuel to an engine. A part of the pressurized fuel discharged from the fuel pump flows back to the sub-tank through the leakage passage. At that time, the pressurized fuel is jetted from the leakage passage toward the filter member.

SUMMARY

In one aspect of this disclosure, a fuel supply device for supplying a fuel in a fuel tank to an engine includes a fuel pump, a sub-tank configured to store the fuel, a pressurized fuel return passage configured to return a part of a pressurized fuel discharged from the fuel pump into the sub-tank, and a fuel filter disposed at a bottom part of the sub-tank. The fuel filter includes a filter member that has a bag-like shape and is configured to filter the fuel to be suctioned into the fuel pump. A downstream end of the pressurized fuel return passage includes a linear passage part extending linearly from a position above the filter member toward the filter member. The fuel supply device includes a wall member configured to change a flow direction of the pressurized fuel jetted from the linear passage part, so as to prevent the pressurized fuel from running into the filter member.

In accordance with the aspect, the flow direction of the pressurized fuel jetted from the linear passage part of the pressurized fuel return passage is changed by the wall member. Thus, the wall member can prevent the pressurized fuel from violently colliding with the filter member, so that a strong impact on the filter member of the fuel filter by the pressurized fuel can be avoided. Accordingly, deformation of the filter member of the fuel filter caused by the pressurized fuel jetted from the pressurized fuel return passage can be suppressed.

DETAILED DESCRIPTION

As described above, International Patent Publication No. WO2017/141628 discloses one type of fuel supply device to be disposed in a fuel tank and that includes a fuel pump, a sub-tank, a leakage passage, and a fuel filter. The fuel filter is disposed at a bottom of the sub-tank and includes a bag-like filter member. When the fuel pump is driven, the fuel pump suctions both the fuel in the fuel tank and the fuel in the sub-tank via the fuel filter, and then pressurizes and discharges the fuel to an engine. A part of the pressurized fuel discharged from the fuel pump flows back to the sub-tank through the leakage passage. At that time, the pressurized fuel is jetted from the leakage passage toward the filter member of the fuel filter, so that there is a possibility that the filter member could be undesirably concavely deformed from being impacted by the fuel jetted from the leakage passage. Therefore, there has been a need for an improved fuel supply device.

Figure 1:
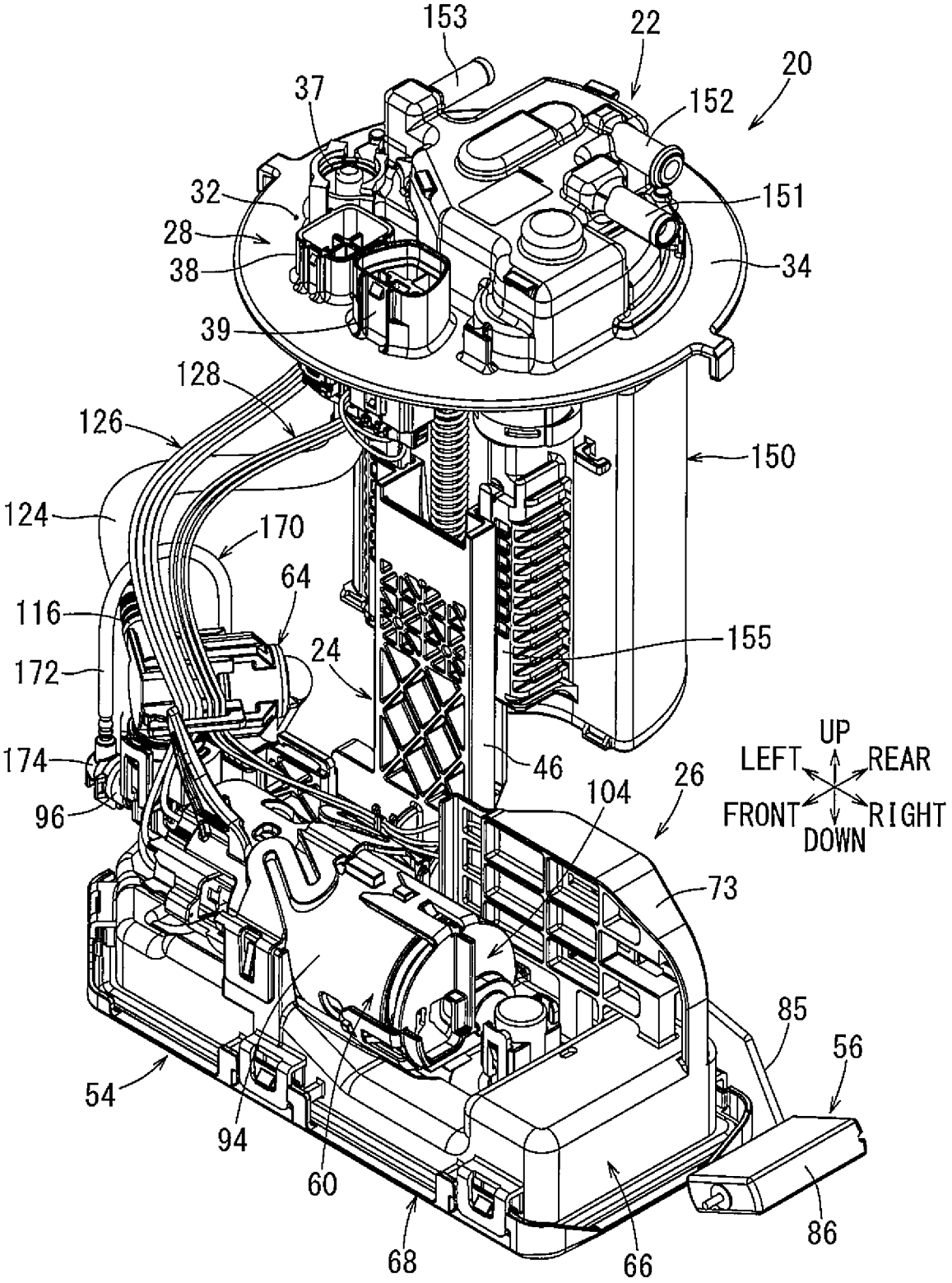
FIG. 1 is a perspective view of a first embodiment of a fuel supply device including a pump unit in accordance with the principles described herein.
Figure 2:
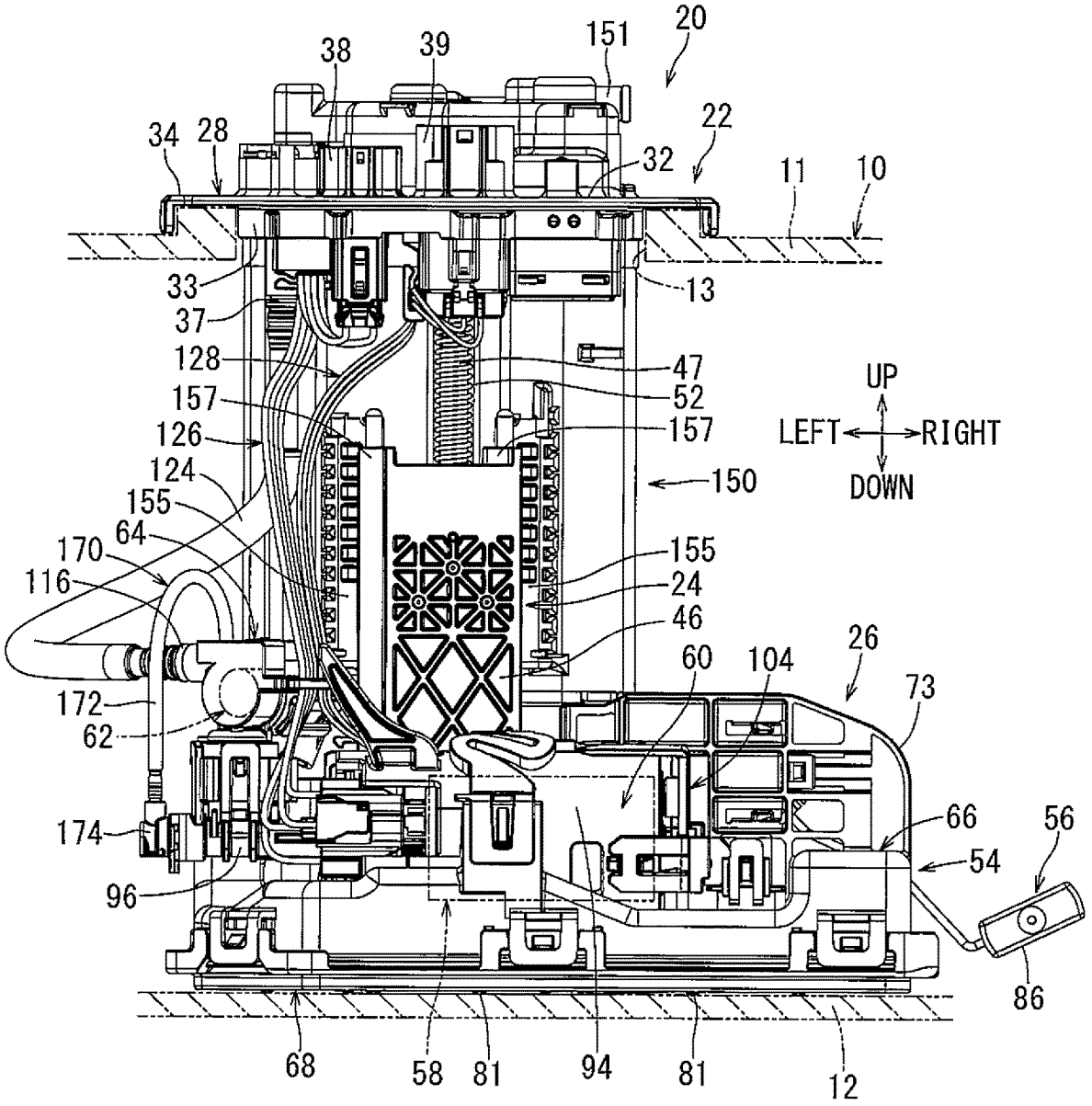
FIG. 2 is a front view of the fuel supply device of FIG. 1.
Figure 3:
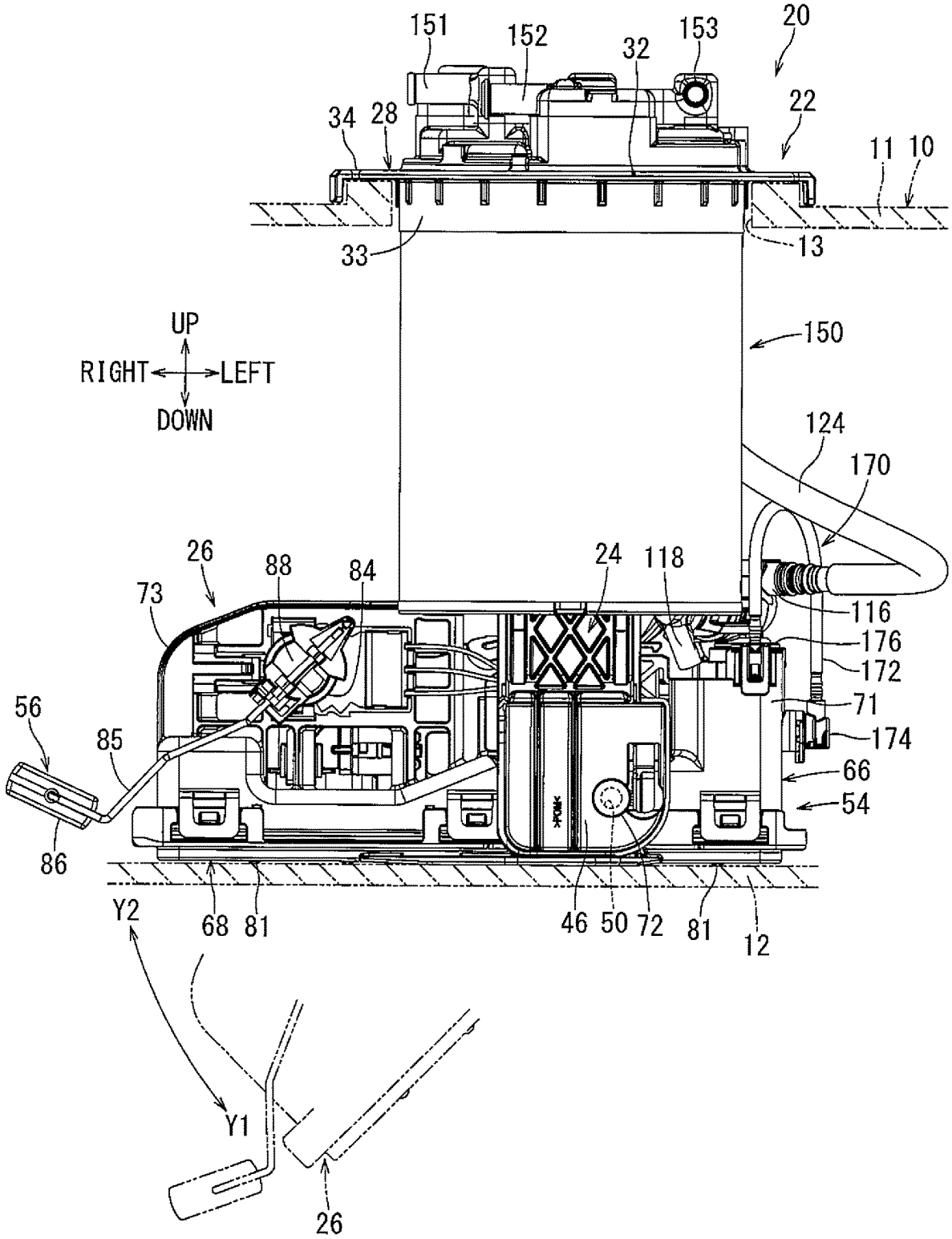
FIG. 3 is a rear view of the fuel supply device of FIG. 1.

Referring now to FIGS. 1 to 3, a first embodiment of a fuel supply device 20 will be described. The fuel supply device 20 is disposed in a fuel tank 10 (FIGS. 2 and 3) mounted on a vehicle, such as an automobile, having an engine, also referred to as an internal combustion engine. The fuel supply device 20 is configured to supply fuel in the fuel tank 10 to the engine. FIG. 1 is a perspective view of the fuel supply device 20, FIG. 2 is a front view of the same, and FIG. 3 is a rear view of the same. In FIGS. 1 to 3, forward, rearward, rightward, leftward, upward, and downward directions are shown and generally correspond to orientations of the vehicle. In other words, the front-rear direction corresponds to the lengthwise direction of the vehicle, the right-left direction corresponds to the width direction of the vehicle, and the up-down direction corresponds to the height direction of the vehicle. In general, each of the front-rear direction and the right-left direction of the fuel supply device 20 may be changed in any horizontal direction.

As shown in FIG. 2, the fuel tank 10 is a hollow container having a top wall 11 and a bottom wall 12. An opening 13 having a circular hole shape is formed in the top wall 11. The fuel tank 10 is mounted on the vehicle, such that both the top wall 11 and the bottom wall 12 are horizontally oriented, i.e. are parallel with a vehicle body. The fuel tank 10 is made of resin, and thus, may deform (mainly expand and contract in the vertical direction) due to variation in the tank internal pressure. The fuel tank 10 is configured to store liquid fuel, such as gasoline, therein.

As shown in FIG. 1, the fuel supply device 20 includes a flange unit 22, a joint member 24, and a pump unit 26. The joint member 24 is coupled to the flange unit 22 and the pump unit 26, and allows the flange unit 22 and the pump unit 26 to move vertically relative to each other.

The flange unit 22 includes a flange body 28 having a lid plate part 32 with a circular plate shape as a main body. The flange body 28 is made of resin. As shown in FIG. 2, a fitting pipe part 33 having a short cylindrical shape is coaxially disposed on a lower surface of the lid plate part 32. A flange part 34 having an annular plate shape is provided along an outer circumference of the lid plate part 32. The flange part 34 extends radially outward beyond the fitting pipe part 33.

As shown in FIG. 1, the lid plate part 32 is provided with a fuel outlet port 37, a first electric connector 38, and a second electric connector 39. The fuel outlet port 37 has a linear pipe shape penetrating the lid plate part 32 in the vertical direction. A predetermined number of metal terminals are arranged in each of the electric connectors 38, 39.

A canister part 150 has a hollow container shape and is formed at a rear portion of the flange body 28. The canister part 150 is formed in substantially a semi-cylindrical shape that is coaxially aligned with the flange body 28. The canister part 150 is filled with an adsorbent e.g. activated carbon configured to adsorb and desorb fuel vapor evaporated in the fuel tank 10. An evaporation port 151, an atmospheric port 152, and a purge port 153 are provided at an upper surface of the flange body 28 and are in fluid communication with an internal space of the canister part 150. A pair of right and left fixed side rails 155 extend linearly in the vertical direction, are provided on the front side of the canister part 150, and are symmetrically arranged in the right-left direction (see FIG. 2).

As shown in FIG. 2, the joint member 24 includes a joint body 46, a spring guide 47, and a pair of right and left movement side rails 157 coupled to the joint member 24. The joint body 46 is made of resin. In addition, the joint body 46 has an elongated plate shape and is vertically oriented such that the joint body 46 is thin in the front-rear direction and extends in the vertical direction. An engagement shaft hole 50 is provided in a lower part of the joint body 46 and extends therethrough (see FIG. 3). The spring guide 47 has a columnar shape and extends vertically upward from a central part of the joint body 46. The movement side rails 157 extend linearly and vertically and are disposed on the right and left sides of the upper part of the joint member 24. The movement side rails 157 are symmetrically arranged in the right-left direction relative to the joint body 46.

The spring guide 47 of the joint member 24 is disposed in a spring 52 comprising a metal coil spring. In this state, the movement side rails 157 of the joint member 24 are moveably engaged with the fixed side rails 155 of the flange unit 22 such that the movement side rails 157 can move together relative to the fixed side rails 155 within a predetermined range in the vertical direction. That is, the joint member 24 is movably coupled to the flange unit 22 such that the joint member 24 and the flange unit 22 can move relative to each other in the vertical direction. The flange body 28 and the joint body 46 are biased apart in the separating direction due to the elasticity of the spring 52.

Figure 4:
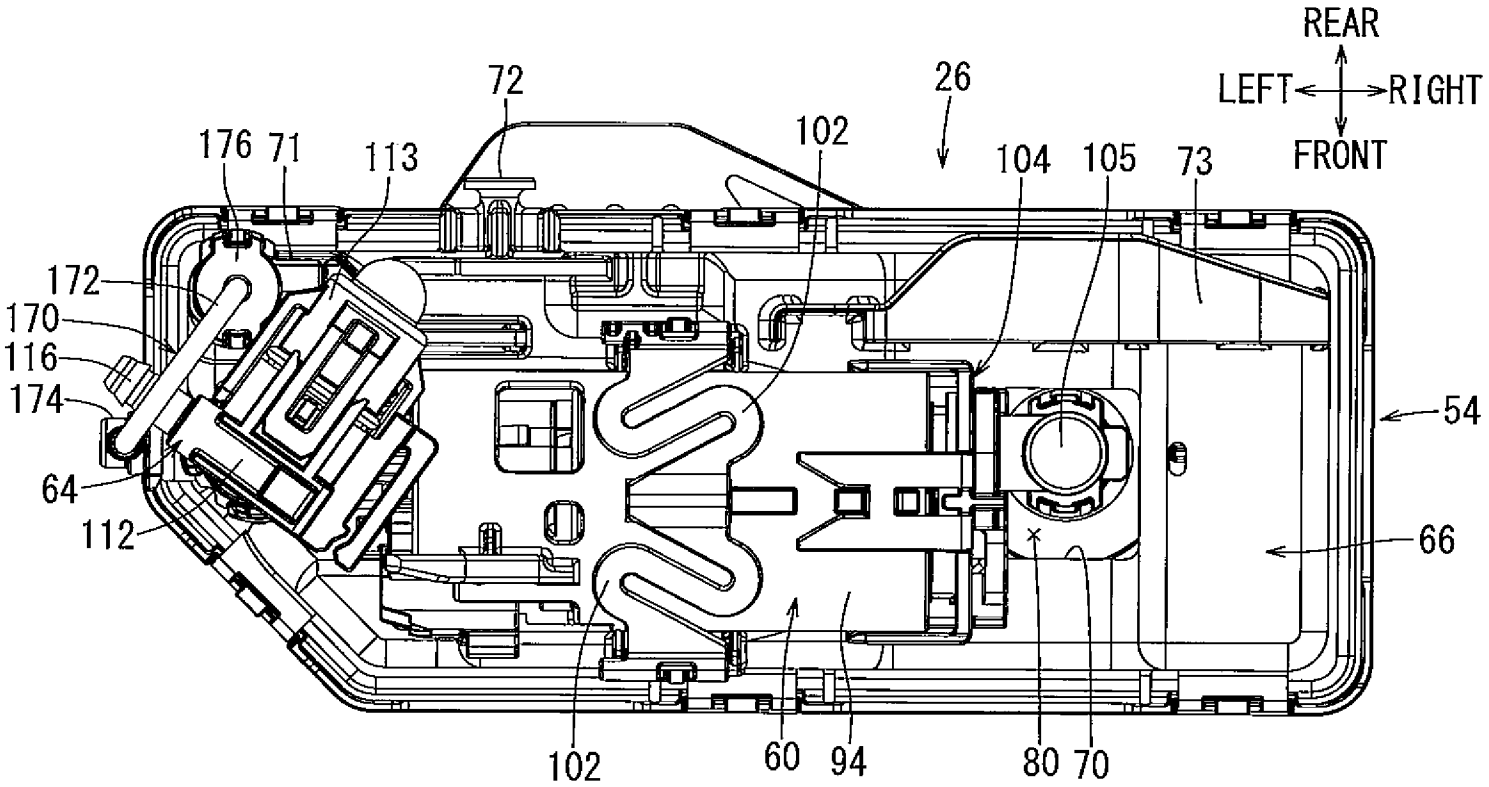
FIG. 4 is a plan view of the pump unit of the fuel supply device of FIG. 1.
Figure 5:
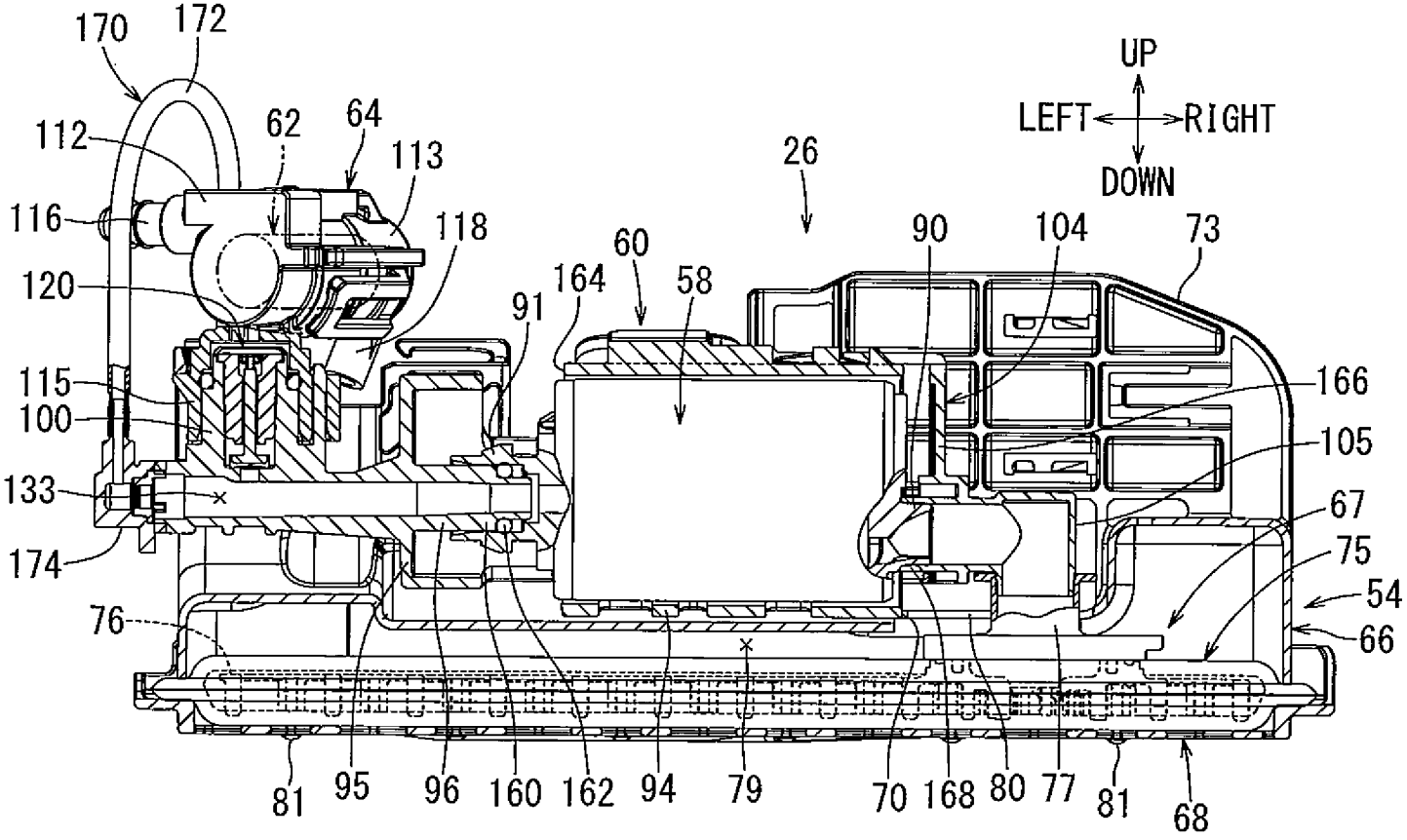
FIG. 5 is a partial cross-sectional front view of the pump unit of FIG. 4.
Figure 6:
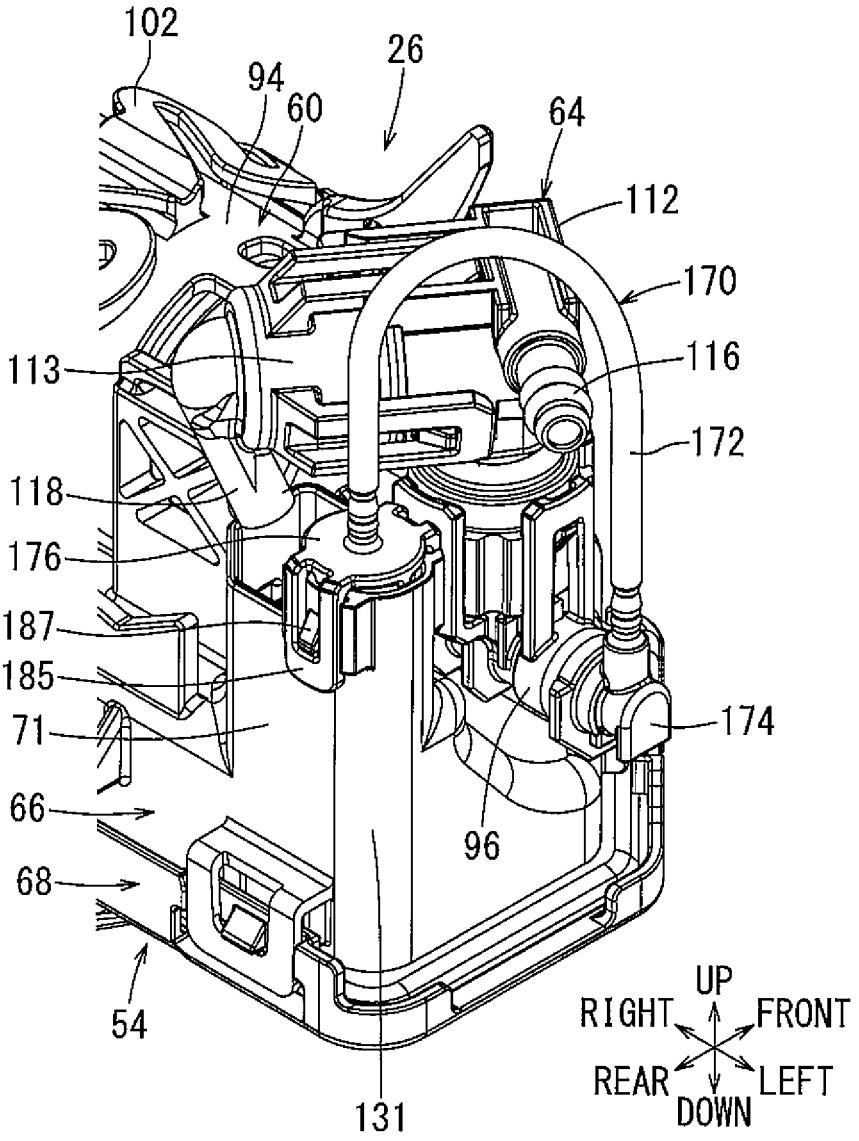
FIG. 6 is a perspective view of a left part of the pump unit of FIG. 4.

As shown in FIG. 2, the pump unit 26 includes a sub-tank 54, a sender gauge 56, a fuel pump 58, a pump case 60, a pressure regulator 62, and a regulator case 64. FIG. 4 is a plan view of the pump unit 26, FIG. 5 is a partially cross-sectional front view of the same, and FIG. 6 is a perspective view of a left part of the same. In FIGS. 4 and 5, the sender gauge 56 is not illustrated.

As shown in FIG. 5, the sub-tank 54 includes a sub-tank body 66, a fuel filter 67, and a cover member 68.

The sub-tank body 66 is made of resin and has a shallow box shape with a lower opening. In particular, sub-tank body 66 has a rectangular shape elongated in the right-left direction in the plan view (see FIG. 4). A square opening 70 is formed on the right side of an upper surface part of the sub-tank body 66. The sub-tank body 66 includes a fuel receiving pipe part 71 having a substantially rectangular pipe shape. The fuel receiving pipe part 71 extends vertically upward from a left rear part of the upper surface of the sub-tank body 66 (see FIG. 6). An upper end of the fuel receiving pipe part 71 is open.

Figure 7:
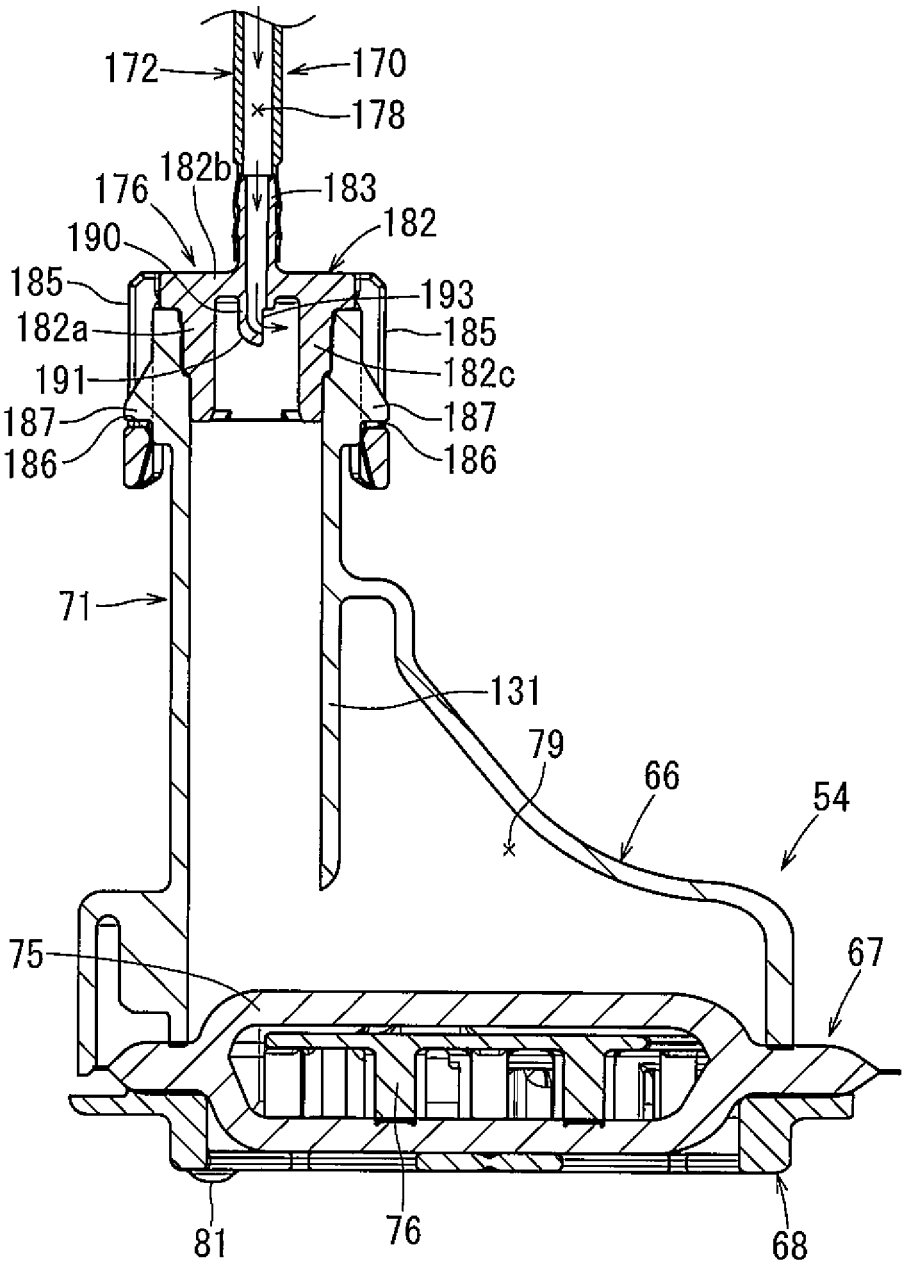
FIG. 7 is a cross-sectional side view of the fuel receiving pipe part of the pump unit of FIG. 4.

FIG. 7 is a cross-sectional side view of the fuel receiving pipe part 71. As show in FIG. 7, a guide pipe part 131 having a hollow, vertically oriented cylindrical shape is provided in the fuel receiving pipe part 71. The guide pipe part 131 is disposed in a left portion of the fuel receiving pipe part 71. A lower end of the guide pipe part 131 is open at a position above a lower surface of the sub-tank body 66. The guide pipe part 131 is integrally formed with the fuel receiving pipe part 71 by utilizing a corner at the intersection of a left side part and a rear side part of the fuel receiving pipe part 71.

As shown in FIGS. 3 and 4, rearwardly extending engagement shaft 72 is provided at a lower left part of a rear surface of the sub-tank body 66. As shown in FIG. 1, the sub-tank body 66 includes a vertically oriented wall 73 having a plate shape. The vertically standing wall 73 faces in the front-rear direction and extends upward from a right rear part of the upper surface part of the sub-tank body 66.

As shown in FIG. 5, the fuel filter 67 includes a filter member 75, an internal frame member 76, and a connection pipe 77. The filter member 75 is configured to filter the fuel. The filter member 75 has a hollow bag-shape and is made of a filter medium that is comprised of a resin-made, non-woven fabric. The external shape of the filter member 75 is generally rectangular such that it is thin in the vertical direction and that its longitudinal direction corresponds to the right-left direction.

The internal frame member 76 is made of resin and has a frame structure holding the filter member 75 in a vertically expanded state. The connection pipe 77 is made of resin and has a vertically oriented cylindrical pipe shape. The connection pipe 77 is coupled to an upper part of the right side of the internal frame member 76 by thermal welding. An upper surface of the filter member 75 is held between the internal frame member 76 and the connection pipe 77. The inside and the outside of the filter member 75 are in fluid communication with each other via the connection pipe 77.

The filter member 75 is attached to the sub-tank body 66 to close the lower opening of the sub-tank body 66. A fuel storing space 79 for storing the fuel is formed between the sub-tank body 66 and the filter member 75. The connection pipe 77 is disposed in the opening 70 of the sub-tank body 66. An annular space between the opening 70 and the connection pipe 77 functions as an inflow port 80 for the fuel. The fuel in the fuel tank 10 (see FIG. 2) flows into the fuel storing space 79 through the inflow port 80 due to its own weight.

The cover member 68 is formed in a latticed plate shape. In particular, the cover member 68 has a rectangular plate shape including a plurality of openings. The cover member 68 is made of resin. The cover member 68 is attached to the sub-tank body 66 by snap-fit. A circumferential periphery of the filter member 75 is held between a circumferential periphery of the sub-tank body 66 and a circumferential periphery of the cover member 68. The cover member 68 covers a lower surface of the filter member 75. A plurality of projections 81 each having a hemispherical shape are formed and distributed on the lower surface of the cover member 68.

As shown in FIG. 7, the guide pipe part 131 of the sub-tank body 66 is spaced apart from the filter member 75 by a predetermined distance in the vertical direction.

As shown in FIG. 3, the sender gauge 56 includes a gauge body 84, an arm 85, and a float 86. The gauge body 84 is attached to a rear surface of the vertically standing wall 73 of the sub-tank body 66. The gauge body 84 includes a rotation member 88 configured to rotate about a horizontal axis. Abase end of the arm 85 is attached to the rotation member 88. A free end of the arm 85 opposite to the base end is coupled to the float 86. The sender gauge 56 is a liquid level indicator for detecting the remaining amount of the fuel in the fuel tank 10, i.e. the position of the liquid level.

As shown in FIG. 5, the fuel pump 58 comprises an electrical fuel pump having a substantially cylindrical shape. The fuel pump 58 includes a motor part and a pump part and is configured to suction the fuel, pressurize the fuel, and discharge the fuel. The fuel pump 58 has a fuel inlet 90 at its right end part on the pump part side and a fuel outlet 91 at its left end part on the motor part side. An electric connector is formed at the left end part of the fuel pump 58. The motor part is comprised of, for example, a brushless continuous current motor.

The pump case 60 includes a case body 94 having a hollow cylindrical shape extending in the right-left direction. The pump case 60 is made of resin. The pump case 60 includes an end plate part 95 to close a left end opening of the case body 94. The end plate part 95 includes a discharge pipe part 96 having a linear pipe shape penetrating the center of the end plate part 95. A connecting pipe part 100 having a cylindrical pipe shape protruding upward is formed at a position near an end part of the discharge pipe part 96. The internal space of the connecting pipe part 100 is in fluid communication with the internal space of the discharge pipe part 96.

A passage, which includes internal passages of the discharge pipe part 96 and the connecting pipe part 100 and through which the pressurized fuel discharged from the fuel pump 58 flows, is referred to as a fuel passage 133. An end part of the discharge pipe part 96 is connected to a leakage passage forming member 170. The leakage passage forming member 170 will be described below.

The fuel pump 58 is housed in the case body 94 in a state where the fuel outlet 91 is directed to the left side. The fuel outlet 91 is connected to an outlet connection port 160 formed at a base end (right end) of the discharge pipe part 96.

As shown in FIG. 4, a pair of front and rear elastic support pieces 102 are formed at an upper end part of the center of the case body 94 in the axial direction thereof. The elastic support pieces 102 extend from the case body 94 in opposite directions such that the elastic support pieces 102 are symmetric with respect to the front-rear direction. Each of the elastic support pieces 102 has an elongated sheet shape and is formed in an S-shape in the plan view. The ends of each elastic support piece 102 are attached to a front side part and a rear side part of the sub-tank body 66 by snap-fit. The pump case 60 is elastically supported on the sub-tank body 66 in a horizontal state, i.e. a laterally mounted state, via the elastic support pieces 102 (see FIG. 5).

As shown in FIG. 5, a resin-made pump cap 104 for closing a right end opening of the case body 94 is attached to the case body 94 by snap-fit. The pump cap 104 includes a cap body 166 having a circular plate shape. A suction pipe part 105 having an elbow pipe shape is formed extends from the cap body 166. The suction pipe part 105 has a horizontal part penetrating the cap body 166 and a vertical part extending downward from a right end of the horizontal part. An inlet connection port 168 is provided at a left end of the horizontal part of the suction pipe part 105 and is connected to the fuel inlet 90 of the fuel pump 58. A lower end of the vertical part of the suction pipe part 105 is connected to the connection pipe 77 of the fuel filter 67 by snap-fit.

As shown in FIG. 5, the external shape of the pressure regulator 62 is substantially formed in a cylindrical shape. The pressure regulator 62 is configured to control the pressure of the pressurized fuel discharged from the fuel pump 58, i.e. the fuel to be supplied to the engine, to a predetermined pressure, and to discharge an excess portion of the fuel.

The regulator case 64 is made of resin and has a hollow cylindrical container shape. The regulator case 64 includes a first case half 112 and a second case half 113, which generally divide the regulator case 64 in the axial direction of the regulator case 64. The case halves 112, 113 are coupled to each other by snap-fit. The pressure regulator 62 is housed in the regulator case 64. The regulator case 64 is mounted with its axial direction horizontally oriented.

A connected pipe part 115 and a fuel discharge part 116 are formed on the first case half 112. The connected pipe part 115 has a hollow cylindrical shape protruding downward from a lower part of the first case half 112. The fuel discharge part 116 protrudes outward from an upper end part of the first case half 112 in a tangential direction. The connected pipe part 115 and the fuel discharge part 116 are in fluid communication with a fuel introduction port of the pressure regulator 62 in the first case half 112.

An outlet pipe part 118 is formed at the second case half 113. The outlet pipe part 118 protrudes downward from a right rear end part of the second case half 113, i.e. an end part opposite to the first case half 112. The outlet pipe part 118 is in fluid communication with an excess fuel outlet of the pressure regulator 62 in the second case half 113. The fuel discharge part 116 is configured to discharge the fuel, the pressure of which is adjusted by the pressure regulator 62. The excess fuel in the pressure regulator 62 is discharged from the outlet pipe part 118. The outlet pipe part 118 is directed to the internal space of the fuel receiving pipe part 71 of the sub-tank body 66 (see FIG. 6).

The connected pipe part 115 of the regulator case 64 is fitted and connected to the connection pipe part 100 of the pump case 60. A check valve 120 is disposed in the connection pipe part 100. The check valve 120 comprises a check valve for holding the residual pressure and is configured to prevent the reverse flow of the pressurized fuel in the connection pipe part 100. The check valve 120 closes due to its own weight but can open in response to the pressure of the fuel.

Figure 8:
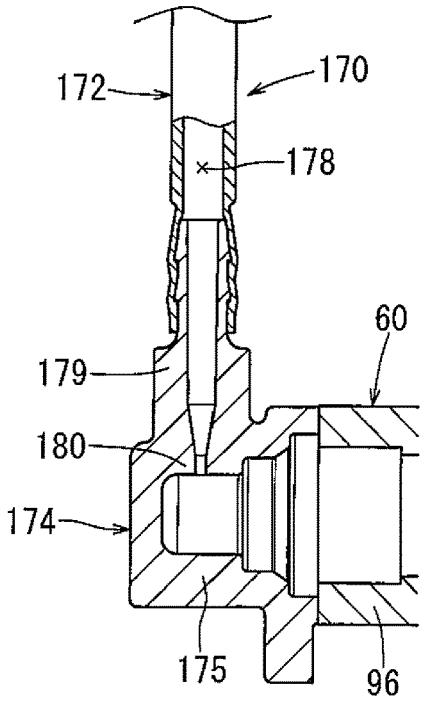
FIG. 8 is a cross-sectional view of the end part of the discharge pipe part of the pump case of the pump unit of FIG. 4.
Figure 9:
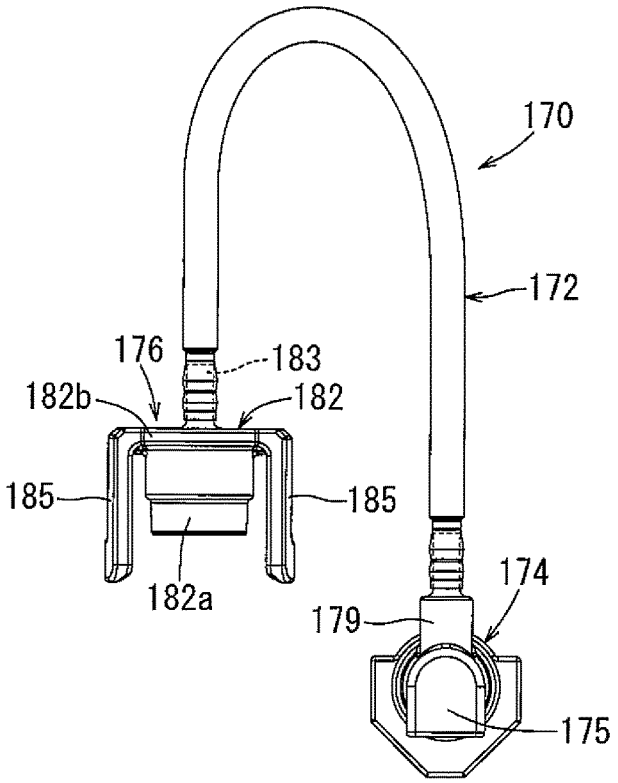
FIG. 9 is a side view of the leakage passage forming member of the pump unit of FIG. 4.

FIG. 9 is a side view of the leakage passage forming member 170. The leakage passage forming member 170 includes a leakage tube 172, a first cap 174 coupled to one end of the leakage tube 172, and a second cap 176 coupled to the other end of the leakage tube 172. The leakage tube 172 and the caps 174, 176 are made of resin. The leakage tube 172 is comprised of a flexible tube. Internal passages of the first cap 174, the leakage tube 172, and the second cap 176 form a continuous leakage passage 178 (see FIGS. 7 and 8). The leakage passage 178 is configured to return the pressurized fuel to the sub-tank 54. The leakage passage 178 may also be referred to herein as a "pressurized fuel return passage." The first cap 174 may also be referred to herein as an "upstream side passage member." The second cap 176 may also be referred to herein as a "downstream side passage member."

FIG. 8 is a cross-sectional view of an end part of the discharge pipe part 96 of the pump case 60. As shown in FIG. 8, the first cap 174 has an elbow pipe shape and includes a cap part 175 and a connection port 179. The cap part 175 has a hollow cylindrical shape with a closed side end. The connection port 179 has a hollow cylindrical shape protruding upward from the cap part 175. The cap part 175 is configured to be connected to the end part of the discharge pipe part 96 of the pump case 60. The connection port 179 has an inner diameter smaller than that of the cap part 175. A restriction part 180, which decreases the passage cross-sectional area, is formed in an upstream end part of the connection port 179. The restriction part 180 is configured to restrict the leakage amount of the pressurized fuel, i.e. the amount of the pressurized fuel flowing through the leakage passage 178 to the sub-tank 54. An end of the leakage tube 172 is connected to the connection port 179 by press-fitting. The cap part 175 is coaxially coupled to the end part of the discharge pipe part 96 by plastic welding.

As shown in FIG. 7, the second cap 176 includes a cap part 182 and a connection port 183. The cap part 182 includes a pipe part 182*a* having a hollow cylindrical shape, and an end plate part 182*b* closing an upper end of the pipe part 182*a*. The cap part 182 is configured to fit to and close an upper end opening of the guide pipe part 131 of the sub-tank body 66. The connection port 183 is formed in a hollow cylindrical shape protruding upward from the center of the end plate part 182*b*. The other end of the leakage tube 172 is connected to the connection port 183 by press-fitting.

A pair of front and rear engagement pieces 185 each having an engagement hole 186 are formed at an outer circumferential part of the end plate part 182*b* of the cap part 182. A pair of front and rear engagement projections 187 are formed on an outer side surface of the upper end of the guide pipe part 131.

The second cap 176 is attached to the guide pipe part 131 of the sub-tank body 66 by snap-fit. In particular, the engagement projections 187 are engaged with the corresponding engagement holes 186 via elastic deformation of the engagement pieces 185 by pressing the second cap 176 on the guide pipe part 131 from above. When the second cap 176 is attached to the guide pipe part 131, the pipe part 182*a* of the cap part 182 is fitted in the upper end opening of the guide pipe part 131. As a result, the end plate part 182*b* closes the upper end opening of the guide pipe part 131.

Figure 10:
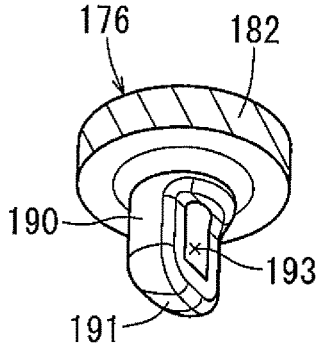
FIG. 10 is a perspective view of the direction change wall part of the second cap of the leakage passage forming member of FIG. 9.

An extended tube part 190 having a hollow cylindrical shape is formed at a lower end part of the connection port 183. The extended tube part 190 protrudes downward from the center of the end plate part 182*b* of the cap part 182. FIG. 10 is a perspective view illustrating a direction change wall part 191 of the second cap 176. As shown in FIG. 10, a lower end of the extended tube part 190 is almost covered by the direction change wall part 191. A pressurized fuel jet port 193 having substantially a vertically elongated square shape is formed at one side of the extended tube part 190. The direction change wall part 191 is formed in substantially a quarter of sphere shape, such that an inner surface of the direction change wall part 191 is concavely curved. The direction change wall part 191 may also be referred to herein as a "wall member." The leakage passage 178 includes a linear portion, which is mainly defined by the connection port 183, near the downstream end thereof. The linear portion of the leakage passage 178 may be referred to herein as a "linear passage part."

An attachment of the pump unit 26 to the flange unit 22 will now be described. As shown in FIG. 3, the engagement shaft 72 of the sub-tank body 66 is rotatably disposed in the engagement shaft hole 50 of the joint body 46 coupled to the flange unit 22. Thus, the pump unit 26 is rotatably coupled to the joint member 24 in the up-down direction (see i.e. the directions indicated by arrows Y1 and Y2 in FIG. 3).

As shown in FIG. 2, the fuel outlet port 37 of the flange unit 22 is connected to the fuel discharge part 116 of the regulator case 64 of the pump unit 26 via a fuel discharge tube 124. The fuel discharge tube 124 comprises a flexible tube made of resin or the like.

The first electric connector 38 of the flange unit 22 is electrically connected to the electric connector of the fuel pump 58 of the pump unit 26 via a first wire harness 126. The second electric connector 39 of the flange unit 22 is electrically connected to the gauge body 84 (see FIG. 3) of the pump unit 26 via a second wire harness 128. The wire harnesses 126, 128 may be hooked on a wire hook part integrally formed on an adjacent resin-made member, as required.

An installation of the fuel supply device 20 will be described. The fuel supply device 20 is changed into an extended state for attaching it to the fuel tank 10. In this state, the joint member 24 is suspended from the flange unit 22, and the pump unit 26 is suspended from the joint member 24. That is, the joint member 24 is moved downward to a lowermost position, i.e. the farthest position, relative to the flange unit 22. Further, the pump unit 26 is rotated relative to the joint member 24 in the downward direction shown by the arrow Y1 in FIG. 3 to an inclined state (illustrated by the two-dot chain line 26 in FIG. 3) where the right side of the pump unit 26 is inclined downward.

Next, the pump unit 26 is inserted into the opening 13 of the fuel tank 10 from above while keeping the fuel supply device 20 in the extended state. The pump unit 26 is changed to a horizontal state by rotating it relative to the joint member 24 in the direction opposite to the suspending process (i.e. the direction shown by the arrow Y2 in FIG. 3) and is disposed on the bottom wall 12 of the fuel tank 10 (see FIGS. 2 and 3). A rotation restriction structure configured to prevent rotation of the pump unit 26 beyond the horizontal state is provided between the joint member 24 and the pump unit 26.

Subsequently, the flange unit 22 is pressed downward against the biasing force of the spring 52, so as to put the canister part 150 in the opening 13 of the fuel tank 10. The flange part 34 of the flange body 28 is fixed on the top wall 11 of the fuel tank 10 by a fixing means (not shown), such as a metal fitting or a bolt. Installation of the fuel supply device 20 to the fuel tank 10 is completed by the above-described process. As a result, the flange unit 22 closes the opening 13 of the fuel tank 10.

A fuel supply pipe connected to the engine is coupled to the fuel outlet port 37 of the flange unit 22. External connectors are connected to the first electric connector 38 and the second electric connector 39. A vapor passage connected to a breather pipe of the fuel tank 10 is coupled to the evaporation port 151. The atmospheric port 152 is open to the surrounding atmosphere. A purge passage connected to an intake passage of the engine is coupled to the purge port 153.

In the installation state of the fuel supply device 20 (see FIGS. 2 and 3), the pump unit 26 is held such that it is pressed on the bottom wall 12 of the fuel tank 10 due to the biasing force of the spring 52. In this state, the projections 81 of the cover member 68 abut the bottom wall 12 of the fuel tank 10, so as to define the fuel flow through space between the cover member 68 and the bottom wall 12.

When the internal pressure of the fuel tank 10 varies due to various factors, such as temperature variations or changes in the residual quantity of the fuel, the fuel tank 10 can deform, i.e. expand or contract, depending on the changes in the tank internal pressure. As a result, the distance between the top wall 11 and the bottom wall 12 of the fuel tank 10 changes, i.e. increases or decreases. In such case, the flange unit 22 and the joint member 24 vertically move relative to each other, so as to follow the height change of the fuel tank 10.

An operation of the fuel supply device 20 will be described. The fuel pump 58 is driven by driving power supplied from the outside. Then, the fuel supplied from the fuel tank 10 via the cover member 68 and/or the fuel in the fuel storing space 79 of the pump unit 26 is suctioned into the fuel pump 58 via the fuel filter 67 and is pressurized therein. The pressurized fuel is discharged from the fuel pump 58 and flows into the regulator case 64 via the discharge pipe part 96 of the pump case 60. In the regulator case 64, the pressure regulator 62 controls the pressure of the pressurized fuel. The pressurized fuel having the controlled pressure flows through the fuel discharge tube 124 and is supplied from the fuel outlet port 37 of the flange unit 22 to the engine. The excess fuel resulting from the pressure controlled by the pressure regulator 62 is discharged from the outlet pipe part 118 of the regulator case 64 into the fuel receiving pipe part 71 of the sub-tank body 66.

The fuel vapor evaporated in the fuel tank 10 is introduced from the vapor passage into the canister part 150 via the evaporation port 151. The fuel vapor in the canister part 150 is purged to the intake passage via the purge passage due to the intake negative pressure. While the fuel vapor in the canister part 150 is purged, atmospheric air is introduced into the canister part 150.

A part of the pressurized fuel that is ejected from the fuel pump 58 into the fuel passage 133 of the discharge pipe part 96 of the pump case 60 is discharged into the fuel receiving pipe part 71 of the sub-tank body 66 via the leakage passage 178 of the leakage passage forming member 170. At this time, the leakage amount of the pressurized fuel is restricted by the restriction part 180 of the first cap 174. The pressurized fuel flows downward through the connection port 183 of the second cap 176 into the extended tube part 190. Then, the flow direction of the pressurized fuel is changed by about 90 degrees by the direction change wall part 191 such that the pressurized fuel is jetted from the pressurized fuel jet port 193 in a direction toward an inner wall surface of the pipe part 182*a* of the cap part 182 (see arrows in FIG. 7). Because the direction change wall part 191 is formed in substantially a quarter of sphere shape, the flow direction of the pressurized fuel is changed smoothly along the flow path. A recessed arc-shaped wall part, which faces the pressurized fuel jet port 193, of the pipe part 182*a* may also be referred to herein as a facing wall 182*c*.

In accordance with the first embodiment, the flow direction of the pressurized fuel is changed by the direction change wall part 191 of the second cap 176 so as to prevent the pressurized fuel from directly impacting the filter member 75. Thus, a strong impact on the upper surface of the filter member 75 of the fuel filter 67 by the pressurized fuel can be avoided. Accordingly, the deformation of the filter member 75 of the fuel filter 67 caused by the pressurized fuel jetted from the leakage passage 178 can be suppressed.

This point will be described. If the direction change wall part 191 of the second cap 176 was not provided, the pressurized fuel would be jetted directly downward from the extended tube part 190 of the second cap 176. Thus, the pressurized fuel would directly run into and impact the upper surface of the filter member 75. The pressurized fuel would violently collide with the filter member 75 such that there is a possibility that the upper surface of the filter member 75 could be concavely deformed. In contrast, in accordance with the first embodiment, because the extended tube part 190 is provided with the direction change wall part 191, the pressurized fuel is prevented from violently running into and impacting the filter member 75. Thus, a strong impact on the upper surface of the filter member 75 by the pressurized fuel can be avoided, thereby suppressing the deformation of the filter member 75.

The direction change wall part 191 of the second cap 176 changes the flow direction of the pressurized fuel. Therefore, the pressurized fuel is jetted from the pressurized fuel jet port 193 laterally. Accordingly, the direct collision of the pressurized fuel with the upper surface of the filter member 75 of the fuel filter 67 can be avoided.

In this embodiment, the direction change wall part 191 and the pressurized fuel jet port 193 are formed at the second cap 176 as one piece. Thus, the structure of the second cap 176 having the direction change wall part 191 and the pressurized fuel port 193 can be simplified, so as to decrease the production cost thereof.

The second cap 176 includes the facing wall 182*c* having a recessed arc shape. The second cap 176 faces the pressurized fuel jet port 193. Thus, the pressurized fuel jetted from the pressurized fuel jet port 193 runs into and impacts the facing wall 182*c* of the second cap 176. Accordingly, the flow direction of the pressurized fuel can be changed, and the flow speed thereof can be decreased so as to decrease the impact force of the pressurized fuel on the filter member 75.

The leakage amount of the fuel can be restricted by the restriction part 180 formed in the first cap 174.

Figure 11:
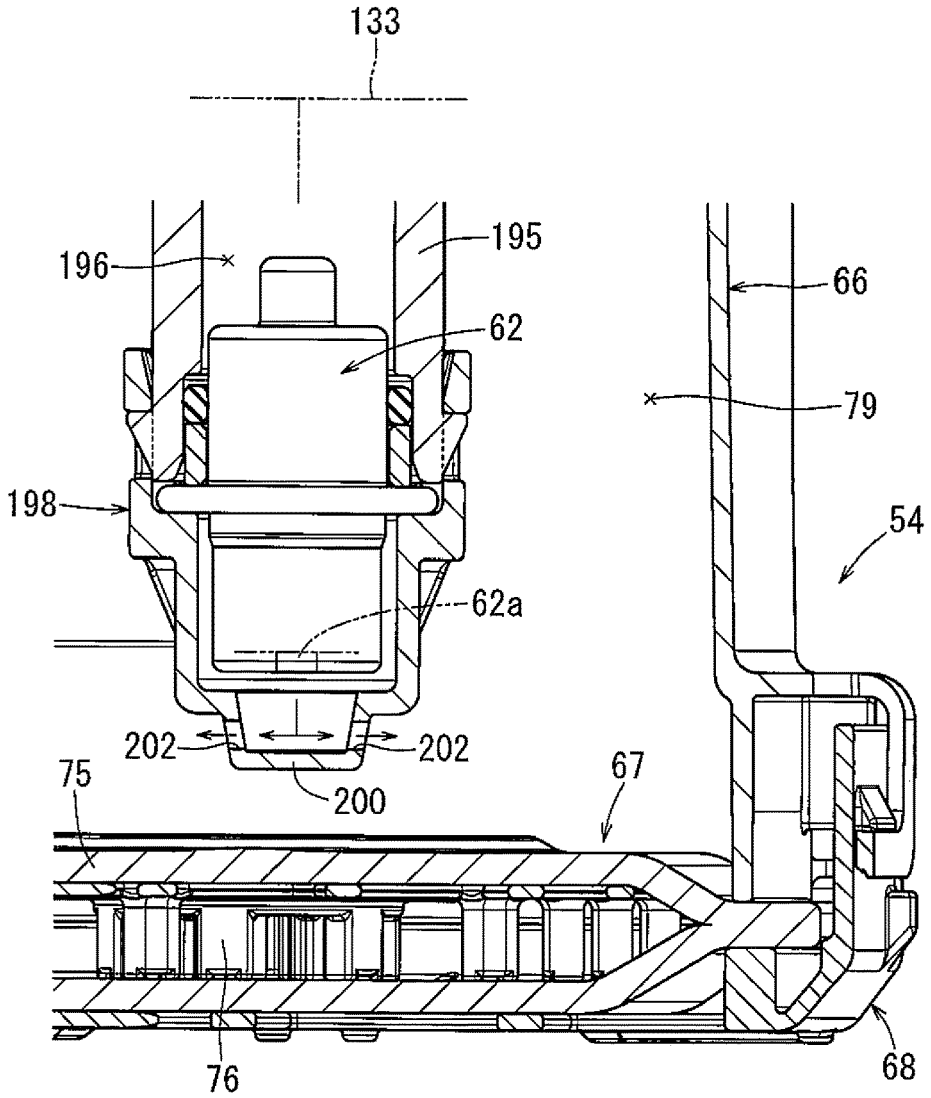
FIG. 11 is a cross-sectional view of a part of a second embodiment of a fuel supply device in accordance with the principles described herein, which illustrates a surrounding area around a pressure regulator.

A second embodiment of the present disclosure substantially corresponds to the first embodiment with some changes. Thus, the changes will be described, and the same components as the first embodiment are annotated with the same reference signs, so as to omit repetitive explanations. FIG. 11 is a cross-sectional view of a surrounding area around the pressure regulator 62. As shown in FIG. 11, a fuel leading pipe part 195 vertically extending is formed at the sub-tank body 66 of the sub-tank 54. Internal passages of the fuel leading pipe part 195 and a retaining member 198 form a continuous fuel leading passage 196. The fuel leading passage 196 is a branch passage branched from the fuel passage 133 for returning the pressurized fuel into the sub-tank 54. The fuel leading passage 196 may also be referred to herein as the "pressurized fuel return passage."

The pressure regulator 62 is attached to a lower end of the fuel leading passage 196. The pressure regulator 62 controls the pressure within the fuel leading passage 196 to a predetermined pressure. The pressure regulator 62 ejects excess fuel directly downward from an excess fuel discharge port 62*a*. The pressure regulator 62 is normally submerged in the fuel stored in the fuel storing space 79. The fuel leading pipe part 195 may also be referred to herein as a "leading passage forming member."

The resin-made retaining member 198, which is configured to prevent detachment of the pressure regulator 62, is attached to the lower end of the fuel leading passage 196, for instance by snap-fit. The retaining member 198 is formed in a hollow cylindrical shape with a closed bottom, such that it covers a lower half of the pressure regulator 62 with a predetermined gap formed therebetween. The retaining member 198 includes a direction change wall part 200 having a hollow cylindrical shape with a closed bottom. The direction change wall part 200 extends downward from the center of a bottom part of the retaining member 198. The closed bottom of the direction change wall part 200 faces the excess fuel discharge port 62*a*. A plurality of pressurized fuel jet ports 202 (two of them are illustrated in FIG. 11) are formed in a side wall of the direction change wall part 200. The flow direction of the pressurized fuel ejected from the excess fuel discharge port 62*a* of the pressure regulator 62 is changed by almost 90 degrees by the bottom wall of the direction change wall part 200. Then, the pressurized fuel is jetted laterally from the pressurized fuel jet ports 202 (see arrows in FIG. 11). The direction change wall part 200 may also be referred to herein as the "wall member."

In accordance with the second embodiment, the pressurized fuel jetted from the excess fuel discharge port 62*a* of the pressure regulator 62 disposed at the downstream end of the fuel leading passage 196 collides with the direction change wall part 200 of the retaining member 198. Accordingly, the direct collision of the pressurized fuel with the upper surface of the filter member 75 of the fuel filter 67 can be avoided.

This point will be described. If the direction change wall part 200 of the retaining member 198 were to be cut and removed to form an opening, the pressurized fuel would be jetted directly downward from the excess fuel discharge port 62*a*. The pressurized fuel would therefore directly run into and impact the upper surface of the filter member 75. Thus, the pressurized fuel would violently collide with the filter member 75 such that there is a possibility that the upper surface of the filter member 75 could be concavely deformed. In contrast, in accordance with the second embodiment, the retaining member 198 is provided with the direction change wall part 200. This prevents the pressurized fuel from directly colliding with the upper surface of the filter member 75, thereby suppressing the deformation of the filter member 75.

Although the technology disclosed herein is described above on the basis of the specific embodiments, it can be carried out in other various embodiments. For example, the technology of this disclosure can be applied to some fuel supply devices other than the fuel supply device 20 for the vehicle, such as an automobile. The wall member may be formed separately from the downstream side passage member or the leading passage forming member. In this case, the pressurized fuel jetted from the pressurized fuel jet port runs into the wall member, so as to change the direction thereof. Although a part of the pipe part 182*a* of the cap part 182 of the second cap 176 functions as the facing wall 182*c* in the embodiment, a dedicated facing wall may be formed at the second cap 176 separately from the pipe part 182*a*.

Various aspects of the technology are disclosed herein. A first aspect is a fuel supply device for supplying a fuel in a fuel tank to an engine, wherein the fuel supply device includes a fuel pump, a sub-tank for storing the fuel, a pressurized fuel return passage for returning a part of a pressurized fuel discharged from the fuel pump into the sub-tank, a fuel filter disposed at a bottom part of the sub-tank and including a filter member that has a bag-like shape and is configured to filter the fuel to be suctioned into the fuel pump, and a wall member configured to change a flow direction of the pressurized fuel jetted from the pressurized fuel return passage, so as to prevent the pressurized fuel from running into the filter member.

In accordance with the first aspect, the flow direction of the pressurized fuel jetted from the pressurized fuel return passage is changed by the wall member, so that the direct collision of the pressurized fuel with the filter member of the fuel filter can be avoided. Accordingly, the deformation of the filter member of the fuel filter caused by the pressurized fuel jetted from the pressurized fuel return passage can be suppressed.

A second aspect is the fuel supply device of the first aspect, wherein the pressurized fuel return passage defines a leakage passage configured to leak the part of the pressurized fuel discharged from the fuel pump. The fuel supply device includes a downstream side passage member defining a downstream end of the leakage passage. The wall member is formed at the downstream side passage member. A pressurized fuel jet port configured to jet the pressurized fuel, the flow direction of which has been changed by the wall member, is formed at the downstream side passage member.

In accordance with the second aspect, the flow direction of the pressurized fuel, which has passed through the leakage passage, is changed by the wall member of the downstream side passage member, and then the pressurized fuel is jetted from the pressurized fuel jet port. Accordingly, the direct collision of the pressurized fuel with the filter member of the fuel filter can be avoided.

A third aspect is the fuel supply device of the second aspect, wherein the wall member and the pressurized fuel jet port are formed at the downstream side passage member as one piece.

In accordance with the third aspect, the structure of the downstream side passage member including both the wall member and the pressurized fuel jet port can be simplified, so as to decrease the manufacturing cost thereof.

A fourth aspect is the fuel supply device of the second or third aspect, wherein the downstream side passage member includes a facing wall having a recessed arc shape and facing the pressurized fuel jet port.

In accordance with the fourth aspect, the pressurized fuel jetted from the pressurized fuel jet port runs into the facing wall of the downstream side passage member. Accordingly, the flow direction of the pressurized fuel can be changed, and the speed thereof can be decreased.

A fifth aspect is the fuel supply device of the first or second aspect, wherein the fuel supply device includes an upstream side passage member defining an upstream end of the leakage passage. The upstream side passage member includes a restriction part configured to restrict a fuel leakage amount.

In accordance with the fifth aspect, the fuel leakage amount can be restricted by the restriction part formed at the upstream side passage member.

A sixth aspect is the fuel supply device of the first aspect, wherein the pressurized fuel return passage defines a fuel leading passage configured to lead the part of the pressurized fuel discharged from the fuel pump. The fuel supply device includes a leading passage forming member defining the fuel leading passage. The leading passage forming member is provided with a pressure regulator configured to control a pressure of the pressurized fuel and to discharge an excess portion of the pressurized fuel. A retaining member configured to prevent detachment of the pressure regulator is attached to the leading passage forming member. The wall member is formed at the retaining member. A pressurized fuel jet port configured to jet the pressurized fuel, the flow direction of which has been changed by the wall member, is formed at the retaining member.

In accordance with the sixth aspect, it is able to make the pressurized fuel, which is jetted from the pressure regulator provided at a downstream end of the fuel leading passage, run into the wall member of the retaining member. Accordingly, the direct collision of the pressurized fuel with the filter member of the fuel filter can be avoided.

The invention claimed is:

1. A fuel supply device for supplying a fuel in a fuel tank to an engine, the fuel supply device comprising:

a fuel pump;

a sub-tank coupled to the fuel pump and configured to store the fuel;

a pressurized fuel return passage in fluid communication with an outlet of the fuel pump, wherein the pressurized fuel return passage is configured to flow a part of a pressurized fuel discharged from the fuel pump into the sub-tank;

a fuel filter disposed at a bottom part of the sub-tank and including a filter member having a bag-like shape and configured to filter the fuel suctioned into the fuel pump, wherein a downstream end of the pressurized fuel return passage includes a linear passage part extending linearly toward the filter member along a central axis to a downstream end that is spaced from the filter member; and a wall member positioned between the linear passage part of the pressurized fuel return passage and the filter member such that the linear passage part extends linearly toward the wall member, wherein the wall member extends radially at the downstream end of the linear passage part with respect to the central axis.

2. The fuel supply device according to claim 1, further comprising:

a downstream side passage member defining the linear passage part of the pressurized fuel return passage, wherein:

the wall member is formed at the downstream side passage member;

the downstream side passage member includes a pressurized fuel jet port configured to jet the pressurized fuel; and the pressurized fuel jet port is located downstream of the wall member.

3. The fuel supply device according to claim 2, wherein the wall member and the pressurized fuel jet port are formed at the downstream side passage member as one piece.

4. The fuel supply device according to claim 2, wherein the downstream side passage member includes a facing wall having a recessed arc shape and facing the pressurized fuel jet port; and wherein a lower end of the facing wall is positioned directly above the filter member.

5. The fuel supply device according to claim 1, further comprising:

an upstream side passage member defining an upstream end of the pressurized fuel return passage, wherein the upstream side passage member includes a restriction part configured to restrict a fuel leakage amount.

6. The fuel supply device according to claim 1, wherein the filter member includes a horizontally oriented upper surface part; and wherein the linear passage part extends linearly toward the horizontal upper surface part in a direction oriented perpendicular to the upper surface part.

7. The fuel supply device according to claim 1, wherein a projection of the central axis of the linear passage part intersects the filter member, and wherein the projection of the central axis of the linear passage part passes through the wall member.

8. The fuel supply device according to claim 1, wherein a flow direction of the pressurized fuel jetted from the linear passage part is directed toward the filter member.

9. The fuel supply device according to claim 8, wherein the flow direction of the pressurized fuel jetted from the linear passage part intersects the wall member.

10. The fuel supply device according to claim 2, wherein a flow direction of the pressurized fuel jetted from the pressurized fuel jet port is non-parallel to a flow direction of the pressurized fuel within the linear passage part.

11. The fuel supply device of claim 1, wherein the wall member comprises a curved shape positioned at the downstream end of the linear passage part.

12. The fuel supply device of claim 1, wherein the wall member comprises a quarter spherical shape.

13. A fuel supply device for supplying a fuel in a fuel tank to an engine, fuel supply device comprising:

a fuel pump;

a sub-tank coupled to the fuel pump and configured to store the fuel;

a pressurized fuel return passage in fluid communication with an outlet of the fuel pump, wherein the pressurized fuel return passage is configured to flow a part of a pressurized fuel discharged from the fuel pump into the sub-tank;

a fuel filter disposed at a bottom part of the sub-tank and including a filter member having a bag-like shape, wherein the filter member is configured to filter the fuel suctioned into the fuel pump;

a leading passage forming member defining the pressurized fuel return passage;

a pressure regulator attached to the leading passage forming member and configured to control a pressure of the pressurized fuel and configured to discharge an excess portion of the pressurized fuel; and a retaining member attached to a downstream end of the leading passage forming member and configured to hold the pressure regulator at the downstream end of the leading passage forming member, wherein:

the retaining member includes a wall member positioned between an outlet of the pressure regulator and the filter member such that the excess portion of the pressurized fuel is discharged from the outlet of the pressure regulator toward the wall member; and the retaining member includes a pressurized fuel jet port disposed downstream of the wall member and configured to jet the pressurized fuel into the sub-tank.

14. The fuel supply device according to claim 13, wherein the wall member is positioned between the pressure regulator and the filter member in a flow direction of the pressurized fuel discharged from the pressure regulator.

15. The fuel supply device according to claim 13, wherein a flow direction of the pressurized fuel jetted from the pressurized fuel jet port is non-parallel to a flow direction of the pressurized fuel discharged from the pressure regulator.

* * * * *